US007573361B2

(12) United States Patent
Sakurai et al.

(10) Patent No.: US 7,573,361 B2
(45) Date of Patent: Aug. 11, 2009

(54) SOLENOID ACTUATOR AND BIAXIAL ACTUATOR

(75) Inventors: Satoshi Sakurai, Shinagawa (JP); Yuriko Segawa, Shinagawa (JP); Nobuyoshi Shimizu, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 120 days.

(21) Appl. No.: 11/584,495

(22) Filed: Oct. 23, 2006

(65) Prior Publication Data

US 2007/0120633 A1 May 31, 2007

(30) Foreign Application Priority Data

Oct. 27, 2005 (JP) ..... 2005-312396

(51) Int. Cl.
*H01F 3/00* (2006.01)
*H01H 9/00* (2006.01)

(52) U.S. Cl. ..... 335/256; 335/207

(58) Field of Classification Search ..... 335/256, 335/205–207, 266, 253, 302–306; 73/1.79, 73/1.41
See application file for complete search history.

(56) References Cited

U.S. PATENT DOCUMENTS 293,076 A * 2/1884 Piette et al. ..... 335/256
1,236,177 A * 8/1917 Jacobs ..... 335/256
2,989,666 A * 6/1961 Brenner et al. ..... 361/144
3,135,880 A * 6/1964 Olson et al. ..... 310/14
3,479,582 A * 11/1969 Meyer ..... 324/207.16
3,502,966 A * 3/1970 Bulgakov et al. ..... 324/207.15
3,513,408 A * 5/1970 McGee ..... 331/65
3,724,479 A * 4/1973 Dimmick ..... 137/83
4,583,067 A * 4/1986 Hara ..... 335/261
4,833,919 A * 5/1989 Saito et al. ..... 73/313
5,045,785 A * 9/1991 Hansen ..... 324/207.16
5,187,475 A * 2/1993 Wagener et al. ..... 340/870.32
5,210,491 A * 5/1993 Hachtel et al. ..... 324/207.19
5,313,161 A * 5/1994 Miyazawa et al. ..... 324/207.16
5,420,413 A * 5/1995 Fields ..... 250/214 PR
5,608,317 A * 3/1997 Hollmann ..... 324/207.2
5,682,097 A * 10/1997 Bryant et al. ..... 324/207.17
5,742,161 A * 4/1998 Karte ..... 324/207.16
6,018,241 A * 1/2000 White et al. ..... 324/207.2
6,168,387 B1 * 1/2001 Able et al. ..... 417/213
6,305,234 B1 * 10/2001 Thies et al. ..... 73/865.9
6,310,472 B1 * 10/2001 Chass ..... 324/207.2
6,459,281 B1 * 10/2002 Carli ..... 324/714
6,469,500 B1 * 10/2002 Schmitz et al. ..... 324/207.16

(Continued)

FOREIGN PATENT DOCUMENTS

JP 2003-306149 10/2003

(Continued)

*Primary Examiner*—Elvin G Enad
*Assistant Examiner*—Alexander Talpalatskiy
(74) *Attorney, Agent, or Firm*—Staas & Halsey LLP

(57) ABSTRACT

A solenoid actuator includes a pair of coils and a core body. The pair of the coils are coupled electrically to each other in series. The core body has a pair of magnets and a holding member, and moves with respect to the coils when the pair of the coils apply magnetic force to the pair of the magnets in substantially same direction. The magnets are inserted into the coils respectively. The holding member holds the pair of the magnets in common.

3 Claims, 24 Drawing Sheets

U.S. PATENT DOCUMENTS

| | | | | |
|---|---|---|---|---|
| 6,753,680 | B2 * | 6/2004 | Wolf | 324/207.2 |
| 6,791,442 | B1 * | 9/2004 | Schmidt | 335/220 |
| 7,130,750 | B1 * | 10/2006 | Stevens et al. | 702/64 |
| 7,281,432 | B2 * | 10/2007 | Omata | 73/800 |

FOREIGN PATENT DOCUMENTS

| | | |
|---|---|---|
| JP | 2004-296129 | 10/2004 |

* cited by examiner

SOLENOID ACTUATOR AND BIAXIAL ACTUATOR

BACKGROUND OF THE INVENTION

1. Field of the Invention

This invention generally relates to a solenoid actuator using an electromagnetic power generated between a coil and a magnet.

2. Description of the Related Art

Generally, a solenoid generates a mechanical linear motion of a movable core inserted in a coil with magnetic power when a given voltage is applied to the coil. Japanese Patent Application Publications No. 2003-306149 and No. 2004-296129 disclose a solenoid using a permanent magnet instead of the movable core.

It is possible to further increase the thrust force of the solenoid mentioned above, when the current given to the coil is enhanced. The current which can be given to the coil is limited actually. On the other hand, the solenoid needs an optical encoder or the like in order to detect a position of a movable object. And the device grows in size and the cost is increased.

SUMMARY OF THE INVENTION

The present invention provides a solenoid which has a simple structure, has relatively high thrust force, and can detect a position with high accuracy.

According to an aspect of the present invention, preferably, there is provided a solenoid actuator including a pair of coils and a core body. The pair of the coils are coupled electrically to each other in series. The core body has a pair of magnets and a holding member, and moves with respect to the coils when the pair of the coils apply magnetic force to the pair of the magnets in substantially same direction. The magnets are inserted into the coils respectively. The holding member holds the pair of the magnets in common.

In accordance with the present invention, it is possible to obtain high thrust force and high response, because electromagnetic powers from the pair of the coils act on the core body in common.

According to another aspect of the present invention, preferably, there is provided a biaxial solenoid actuator including an operation element and a solenoid actuator. The operation element held by a first slider and a second slider is guided so as to be movable in two directions vertical to each other. The solenoid actuator actuates the first slider and the second slider separately. The solenoid actuator has a pair of coils, a pair of magnets, a holding member and a core body. The pair of coils are coupled electrically to each other in series. The pair of magnets are inserted into the coils respectively. The holding member holds the magnets in common. The core body moves with respect to the coils when the pair of the coils apply magnetic force to the pair of the magnets in substantially same direction.

BRIEF DESCRIPTION OF THE DRAWINGS

Preferred embodiments of the present invention will be described in detail with reference to the following drawings, wherein.

DESCRIPTION OF THE PREFERRED EMBODIMENTS

A description will now be given with reference to accompanying drawings, of embodiments of a solenoid actuator in accordance with the present invention.

Figure 1:
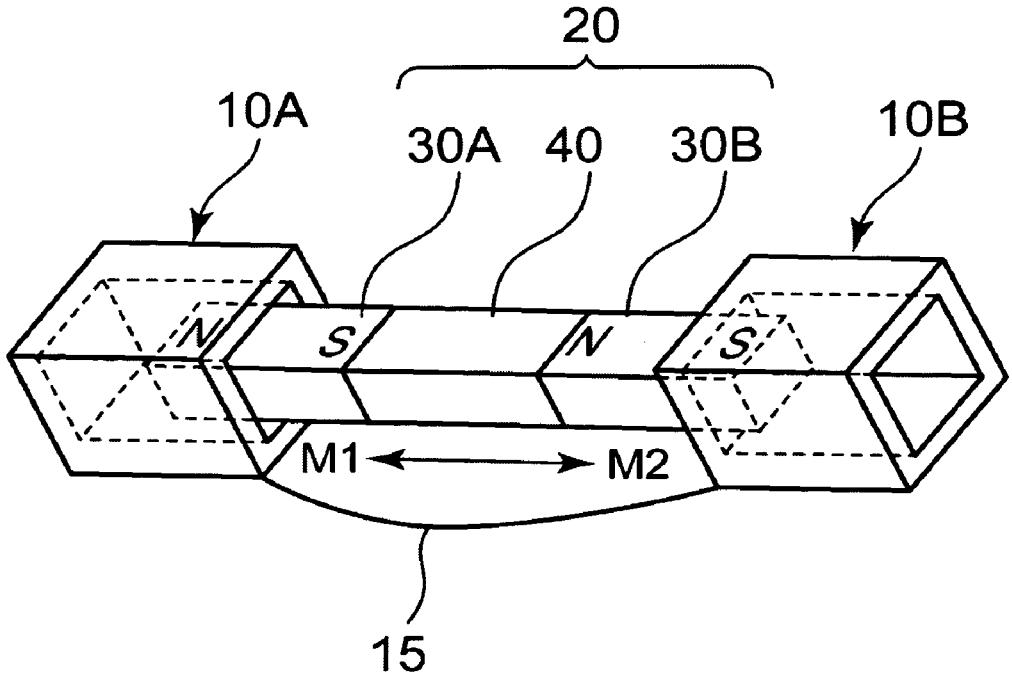
FIG. 1 illustrates an external perspective view of a solenoid actuator in accordance with a first embodiment of the present invention.
Figure 2:
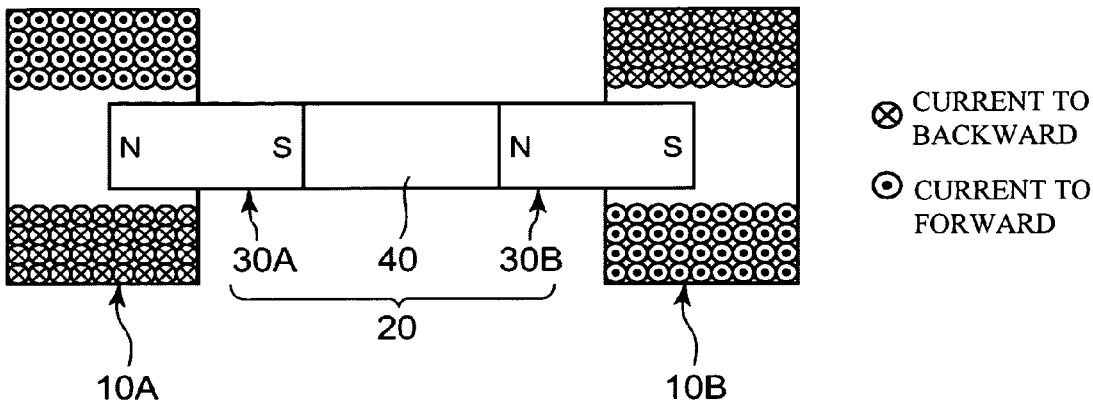
FIG. 2 illustrates a longitudinal cross sectional view of a solenoid actuator.
Figure 3:
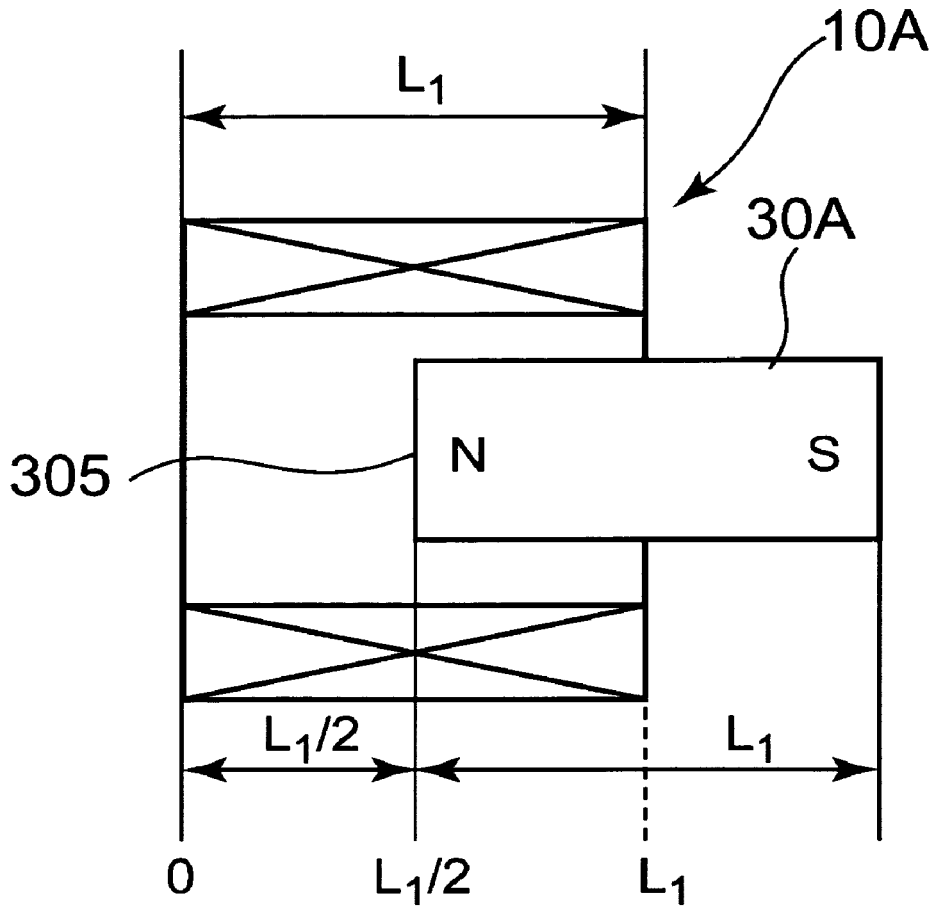
FIG. 3 illustrates an arrangement relationship between a coil and a magnet.
Figure 4:
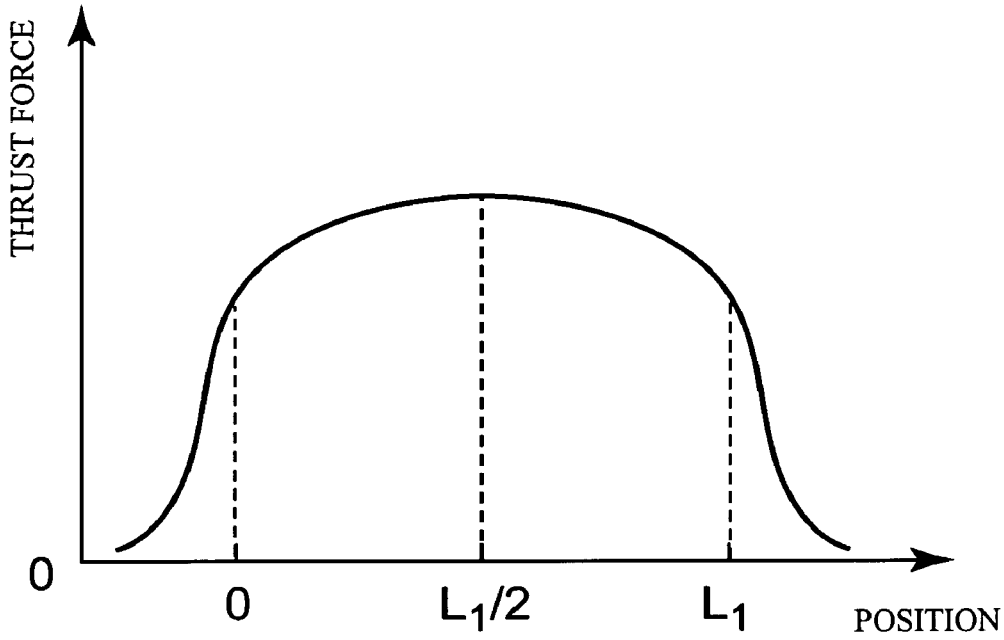
FIG. 4 illustrates a relationship between a relative position of a magnet to a coil and a thrust force.

A description will be given with reference to FIG.1 through FIG. 4, of a solenoid actuator in accordance with an embodiment. FIG. 1 illustrates an external perspective view of the solenoid actuator. FIG. 2 illustrates a longitudinal cross sectional view of the solenoid actuator. FIG. 3 illustrates an arrangement relationship between a coil and a magnet. FIG. 4 illustrates a relationship between a relative position of the magnet to the coil and a thrust force. As shown in FIG. 1, the solenoid actuator has a pair of a coil 10A and a coil 10B, a core body 20 and so on.

As shown in FIG. 1, the coils 10A and 10B have a rectangular cross section, and are coupled electrically to each other in series with an electrical wire 15.

As shown in FIG. 2, winding directions of the coils 10A and 10B are opposite to each other. The coils 10A and 10B are secured to a holding member (not shown) or the like.

The core body 20 has a magnet 30A inserted into the coil 10A, a magnet 30B inserted into the coil 10B, and a holding member 40 holding the magnets 30A and 30B at both ends thereof. The core body 20 is held by a holding member (not shown) and is movable in linear directions M1 and M2 in FIG. 1.

The magnets 30A and 30B have a rectangular cross section, and are arranged so that magnetization directions thereof are substantially equal in the linear directions M1 and M2 shown in FIG. 1. That is, the magnets M1 and M2 have a north pole and a south pole in order in the linear direction M1. The first end surface (magnetized surface) of the core body 20 on the magnet 30A side is a north pole, and second end surface (magnetized surface) on the magnet 30B side is a south pole.

The holding member 40 has a rectangular cross section, and may be made of such as a magnetic material, a ferromagnetic material or a nonmagnetic material. The magnets 30A and 30B and the holding member 40 may be bonded to each other with adhesive material or the like, may be attached to each other with a magnetic power, or may be coupled to each other with a coupling member.

When a current is given to the coils 10A and 10B, magnetic powers having an equal direction are generated between the coil 10A and the magnet 30A and between the coil 10B and the magnet 30B, because of the relationship between the winding directions and the magnetization directions mentioned-above. And the core body 20 moves in one of the linear directions M1 and M2 according to conducting directions to the coils 10A and 10B. A large thrust force is obtained and it is possible to enhance response, because both of the magnetic powers between the coil 10A and the magnet 30A and between the coil 10B and the magnet 30B are generated in the equal directions.

Here, a description will be given of a size relationship and a position relationship between the coils and the magnets. As shown in FIG. 3, although the lengths of the coil 10A and magnet 30A are L1, the length of the coil 10A may be substantially equal to or longer than that of the magnet 30A.

FIG. 4 illustrates a relationship between the position of a magnetized surface 30*f* of the magnet 30A with respect to the coil 10A and a generated thrust force. As shown in FIG. 4, the largest thrust force is generated when the magnetized surface 30*f* is positioned at a center of the coil 10A. The thrust force gets lower and lower when the magnetized surface 30*f* is away from the center of the coil 10A. This relationship is same as that between the coil 10B and the magnet 30B.

Therefore, it is preferable that the magnetized surfaces 30*f* thereof are positioned at approximately center of the coils 10A and 10B respectively when the magnets 30A and 30B are positioned at a reference position. Here, the reference position means an initial position or a starting position where the core body 20 is to be positioned before moving.

Figure 5:
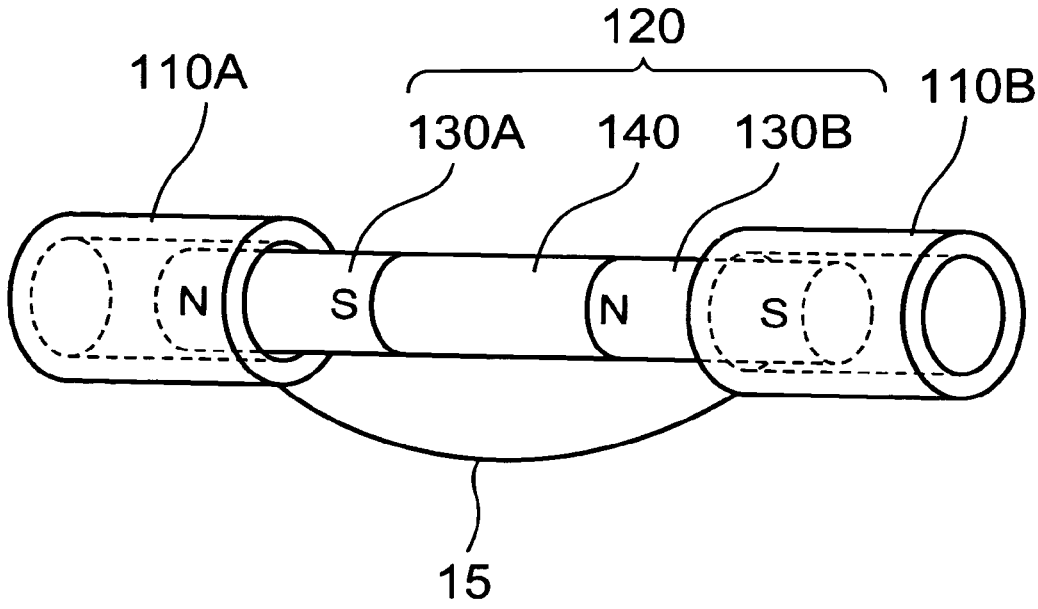
FIG. 5 illustrates an external perspective view of a solenoid actuator in accordance with a second embodiment of the present invention.

FIG. 5 illustrates an external perspective view of a solenoid actuator in accordance with another embodiment of the present invention. In the embodiment above, the coils 10A and 10B and the core body 20 have a rectangular cross section. The solenoid actuator shown in FIG. 5 has coils 110A and 110B, magnets 130A and 130B and a holding member 140 having a circular cross section. The solenoid actuator may have other shapes. It is possible to coat a lubricant on the magnet or to form the coil to be a bobbin, in order to enhance the slidability between the magnet and the coil.

Next, a description will be given of a solenoid actuator in accordance with another embodiment of the present invention, with reference to FIG. 6 through FIG. 9.

Figure 6:
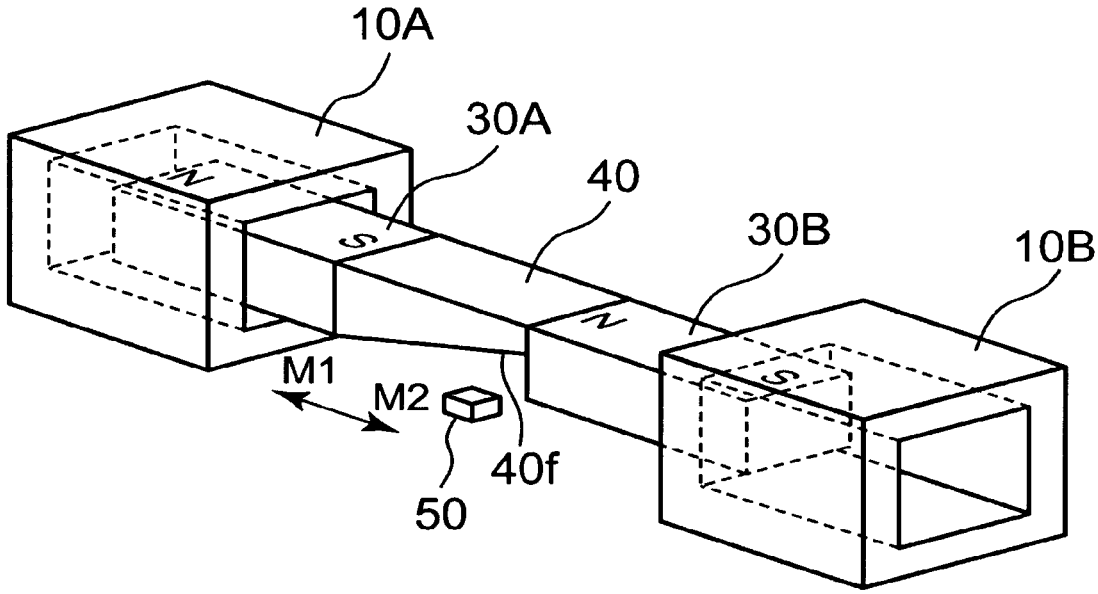
FIG. 6 illustrates an external perspective view of a solenoid actuator having an electromagnetic element.
Figure 7:
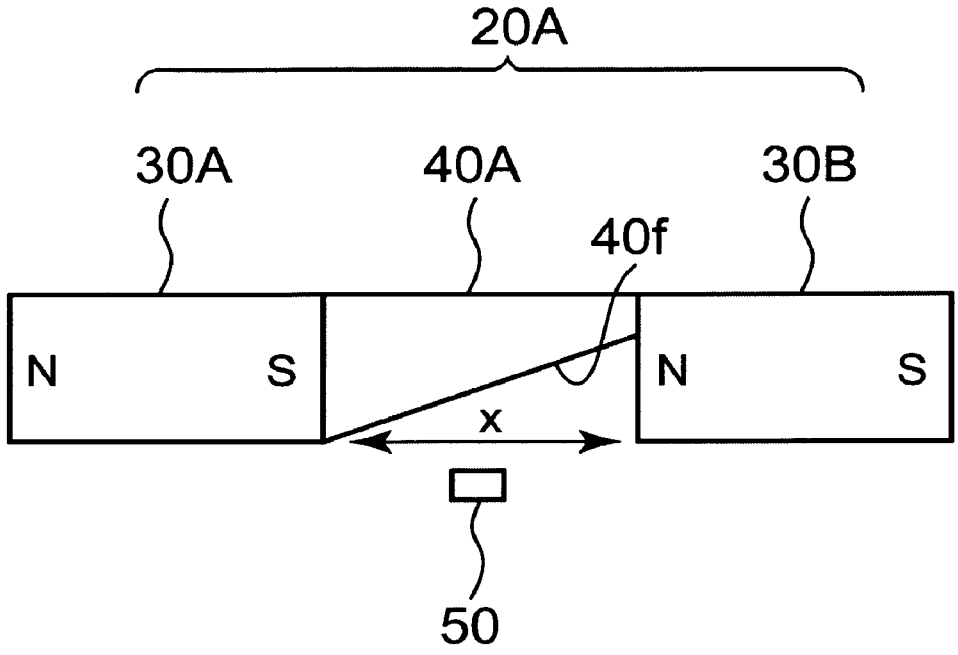
FIG. 7 illustrates a form example of a holding member.
Figure 8A:
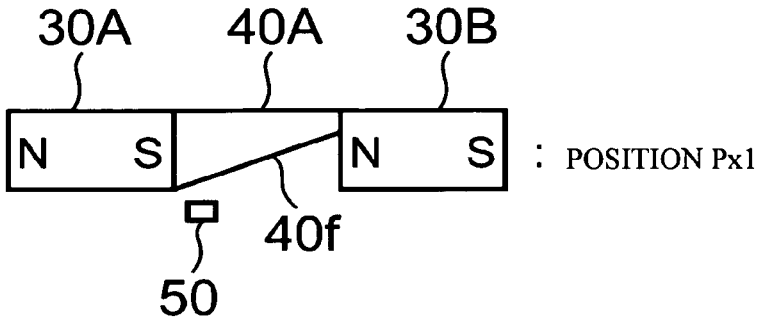
FIG. 8A through FIG. 8C illustrate a positional relationship between a core body and an electromagnetic element.
Figure 8B:
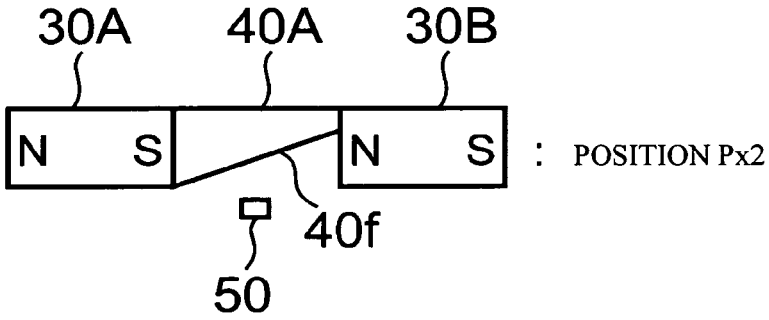
Figure 8C:
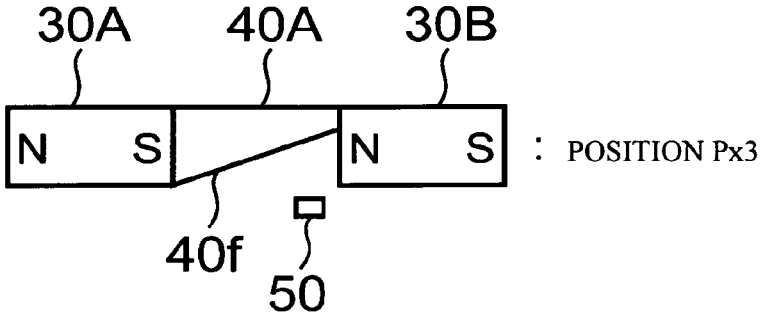
Figure 9:
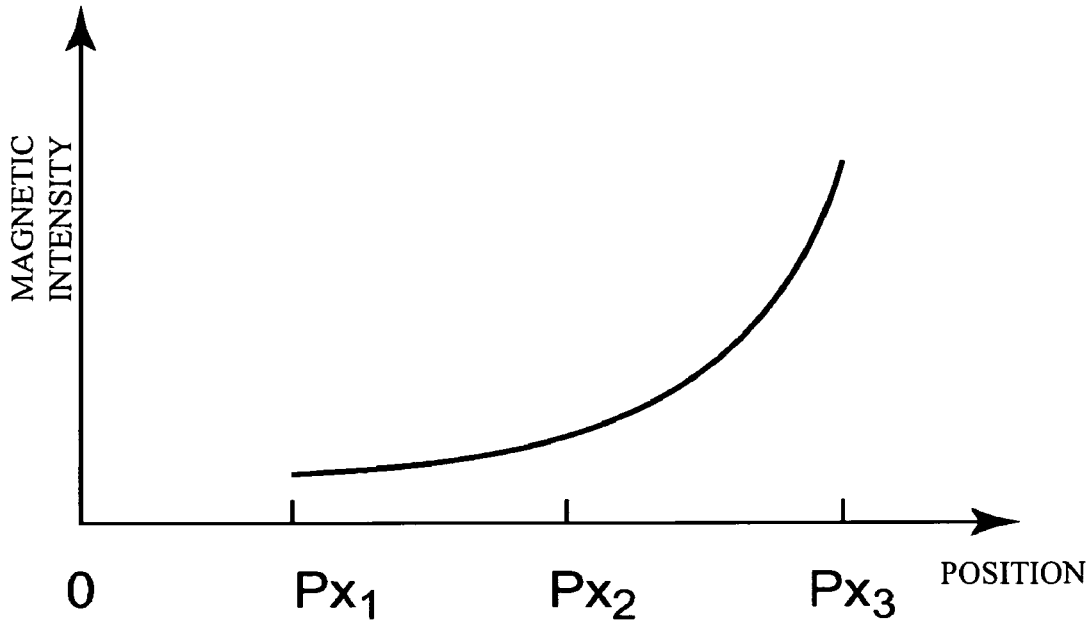
FIG. 9 illustrates a graph showing magnetic intensity which an electromagnetic element detects at every position.

FIG. 6 illustrates an external perspective view of the solenoid actuator having an electromagnetic element. FIG. 7 illustrates a shape example of a holding member. FIG. 8A through FIG. 8C illustrate a positional relationship between a core body and the electromagnetic element. FIG. 9 illustrates a graph showing magnetic intensity which the electromagnetic element detects at every position.

As shown in FIG. 6 and FIG. 7, the solenoid actuator in accordance with the embodiment is different from those mentioned above in a point that the solenoid actuator has an electromagnetic element 50 detecting a position of a core body 20A with respect to the coils 10A and 10B, and a holding member 40A.

The holding member 40A holds the magnet 30A at a first end and holds the magnet 30B at a second end. The holding member 40A may be made of a ferromagnetic material such as iron oxide, chrome oxide, ferrite, nickel, cobalt or the like, or a magnetic material.

This holding member 40A has a sloping surface 40*f* which faces to the electromagnetic element 50 and is inclined to the linear directions M1 and M2 where the core body 20A moves with respect to the coils. The distance between the holding member 40A and the electromagnetic element 50 changes when the core body 20A moves with respect to the coils 10A and 10B.

The electromagnetic element 50 converts the magnetic power generated by the magnets 30A and 30B into an electrical signal, in order to detect a relative position of the core body 20A to the coils 10A and 10B. The electromagnetic element 50 is arranged facing to the sloping surface 40*f*. The electromagnetic element 50 is made of such as a hall element or a magnetoresistive element. As shown in FIG. 7, the electromagnetic element 50 detects a magnetic intensity in an x-direction (the linear directions M1 and M2 of the core body 20).

Here, as shown in FIG. 8A through 8C, relative positions between the electromagnetic element 50 and the core body 20A are referred to Px1, Px2 and Px3 respectively. In this case, the magnetic intensity detected by the electromagnetic element 50 is, for example, shown in FIG. 9.

As shown in FIG. 9, the magnetic intensity detected by the electromagnetic element 50 increases monotonically from the position Px1 to the position Px2. That is, the magnetic intensity changes according to the displacement of the core body 20A. And it is possible to detect the position of the core body 20A with the magnetic intensity detected by the electromagnetic element 50.

Next, a description will be given of a solenoid actuator in accordance with another embodiment, with reference to FIG. 10 through FIG. 14.

Figure 10:
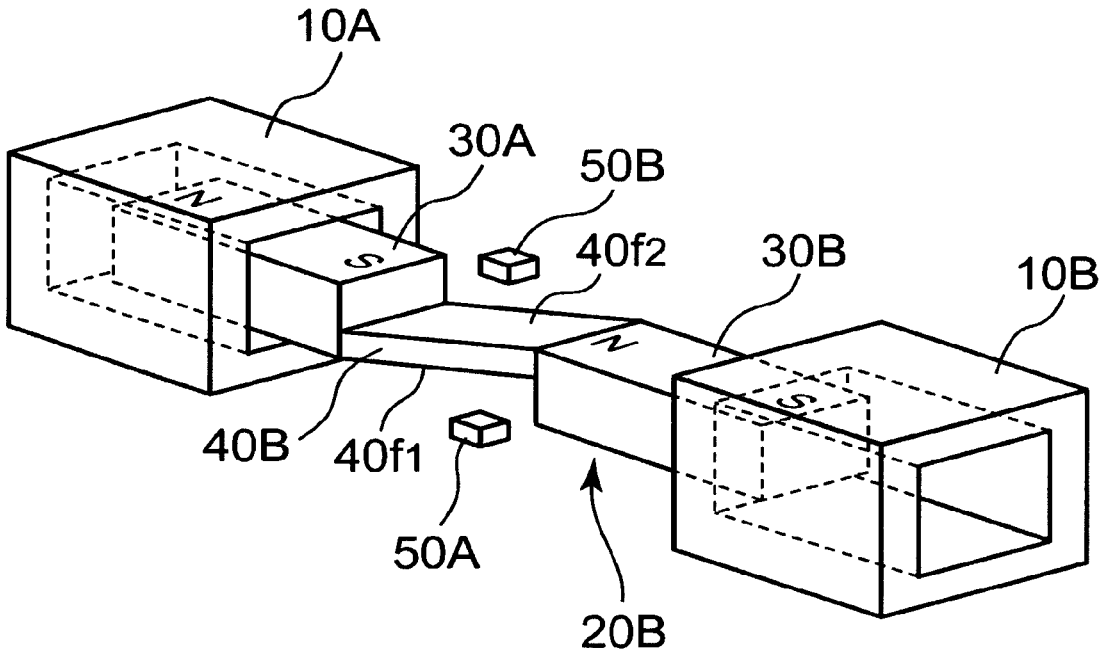
FIG. 10 illustrates an external perspective view of a solenoid actuator having an electromagnetic element.
Figure 11:
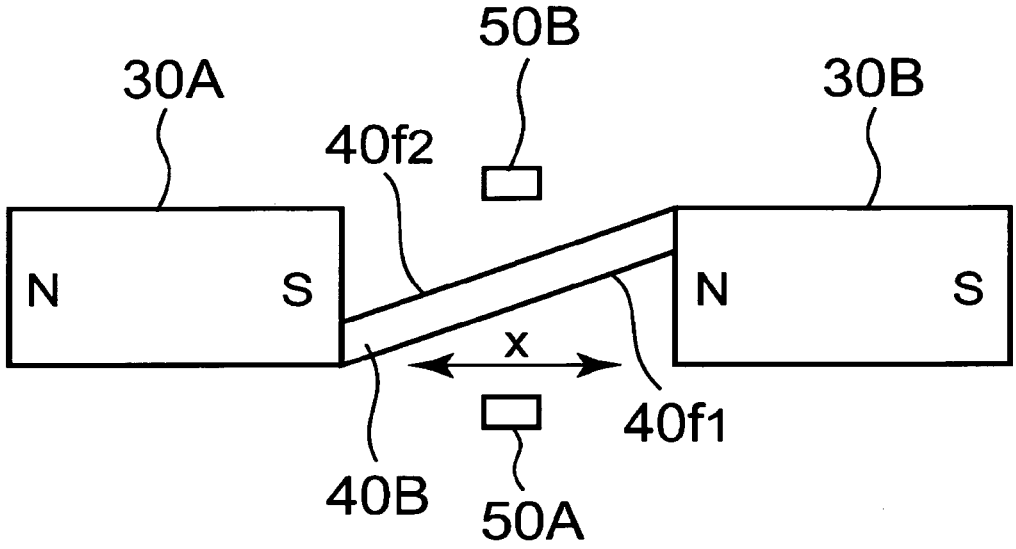
FIG. 11 illustrates a form example of a holding member.
Figure 12A:
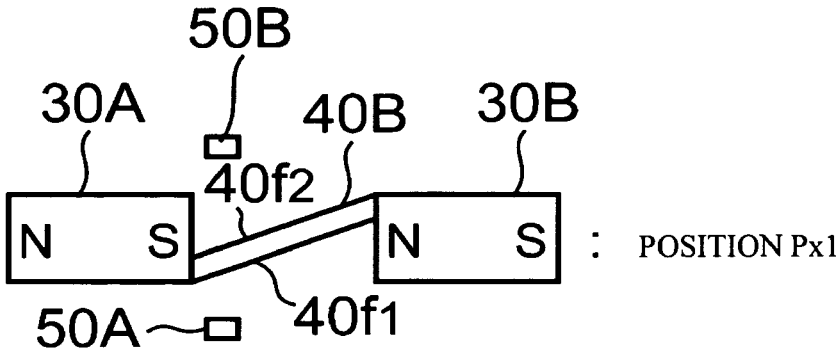
FIG. 12A through FIG. 12C illustrate a positional relationship between a core body and an electromagnetic element.
Figure 12B:
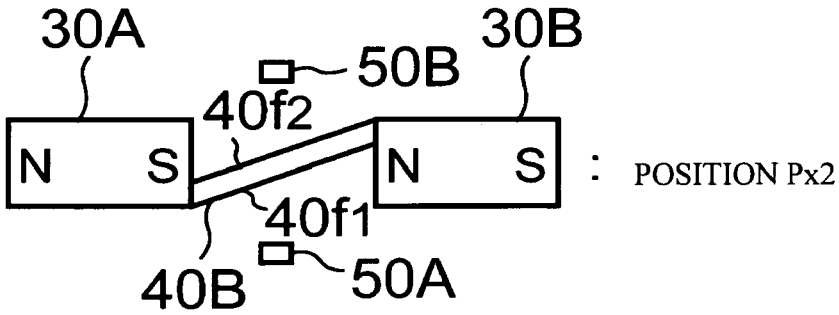
Figure 12C:
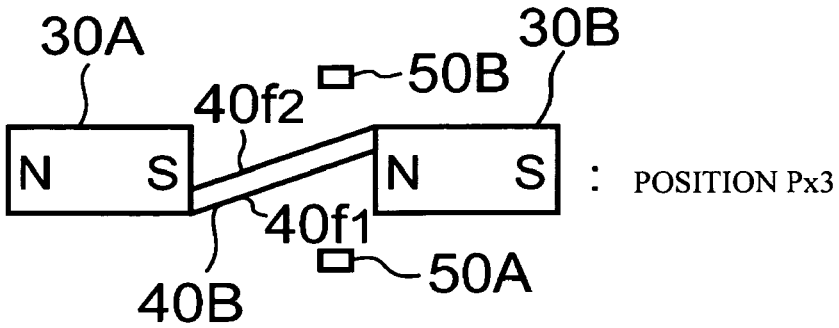
Figure 13:
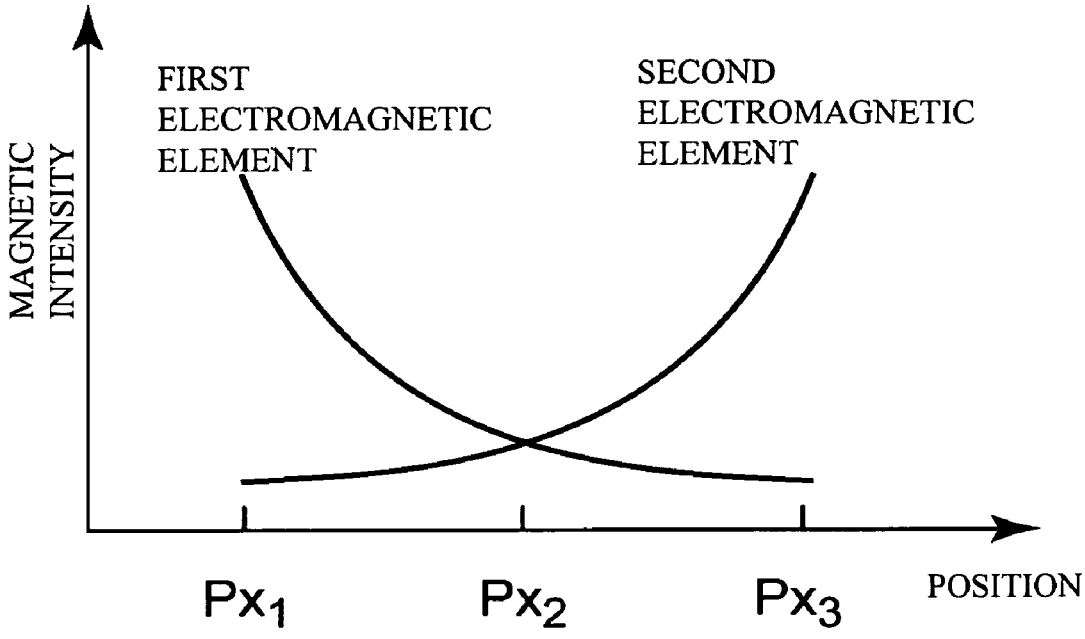
FIG. 13 illustrates a graph showing magnetic intensity which an electromagnetic element detects at every position.
Figure 14:
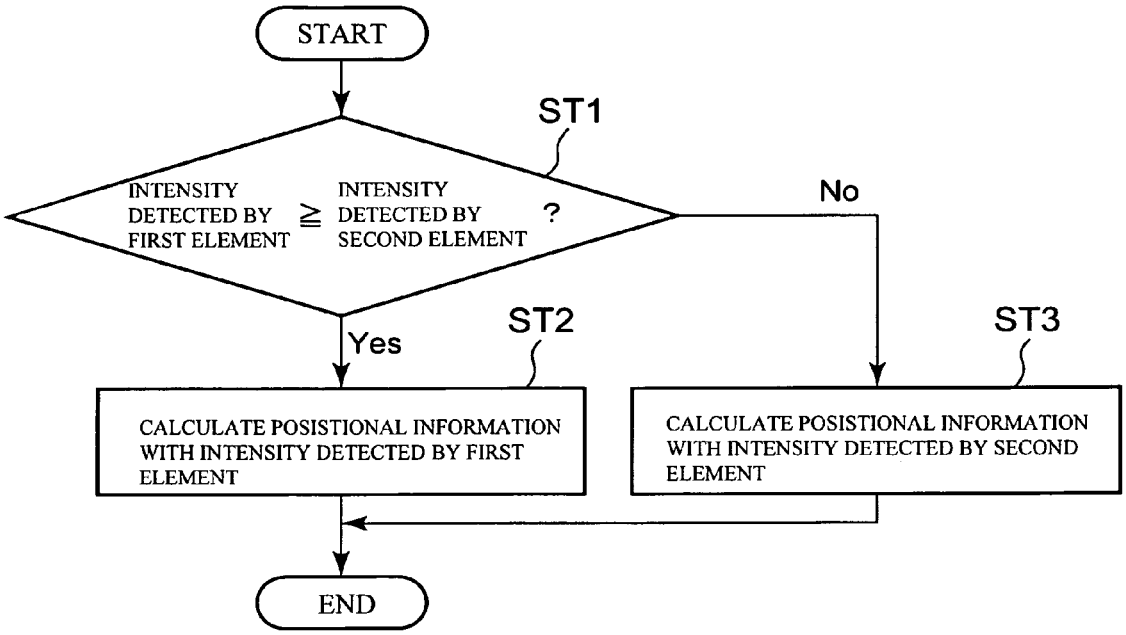
FIG. 14 illustrates a flowchart showing an example of a procedure of position detection in a case where two electromagnetic elements are provided.

FIG. 10 illustrates an external perspective view of the solenoid actuator having an electromagnetic element. FIG. 11 illustrates a shape example of a holding member. FIG. 12A through FIG. 12C illustrate a positional relationship between a core body and the electromagnetic element. FIG. 13 illustrates a graph showing magnetic intensity which the electromagnetic element detects at every position. FIG. 14 illustrates a flowchart showing an example of a procedure of position detection in a case where two electromagnetic elements are provided.

The solenoid actuator in accordance with the embodiment is different from those mentioned above in number of electromagnetic elements and a shape of the holding member. As shown in FIG. 11, a first electromagnetic element 50A and a second electromagnetic element 50B are arranged facing to each other through a holding member 40B. As shown in FIG. 11, the holding member 40B has a sloping surface 40*f*1 facing to the first electromagnetic element 50A and a sloping surface 40*f*2 facing to the second electromagnetic element 50B. The sloping surfaces 40*f*1 and 40*f*2 are inclined to the x-direction with approximately equal angle and in approximately same direction.

Here, as shown in FIG. 12A through 12C, relative positions between the first electromagnetic element 50A and the second electromagnetic element 50B and a core body 20B are referred to Px1, Px2 and Px3 respectively. In this case, the magnetic intensities detected by the electromagnetic elements 50A and 50B are, for example, shown in FIG. 13.

In order to detect the position of the core body with the magnetic intensities detected by the electromagnetic element 50A and 50B, the magnetic intensities are compared (step ST1), as shown in FIG. 14. When the magnetic intensity detected by the first electromagnetic element 50A is larger than that detected by the second electromagnetic element 50B, the position of the core body is detected with the magnetic intensity detected by the first electromagnetic element 50A (ST2). When the magnetic intensity detected by the second electromagnetic element 50B is larger than that detected by the first electromagnetic element 50A, the position of the core body is detected with the magnetic intensity detected by the second electromagnetic element 50B (ST3).

It is possible to detect the position easily, when the magnetic intensities detected by the first electromagnetic element 50A and the second electromagnetic element 50B are compared and the position are detected with the larger magnetic intensity. That is, amount of change of the magnetic intensity according to the position is larger in an area where the magnetic intensity is relatively large as shown in FIG. 13. And it is possible to detect the position easily. In the embodiment, the position is detected with one of the magnetic intensities detected by the first electromagnetic element 50A and the second electromagnetic element 50B. However, it is possible to detect the position of the core body with a differential between the magnetic intensities detected by the first electromagnetic element 50A and the second electromagnetic element 50B.

Next, a description will be given of a solenoid actuator in accordance with another embodiment, with reference to FIG. 15 through FIG. 18.

Figure 15:
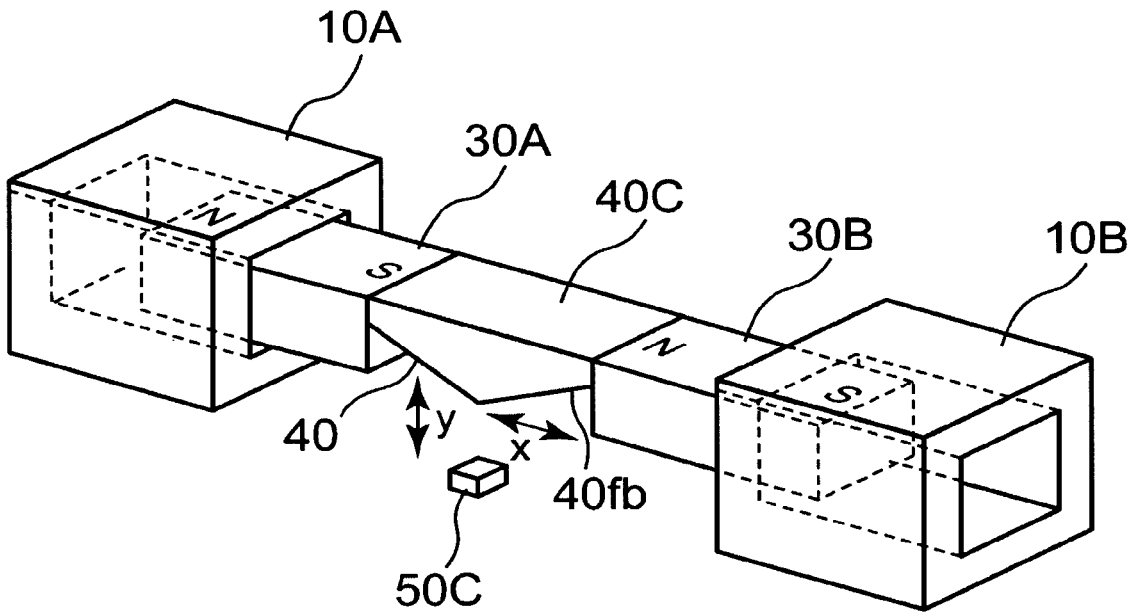
FIG. 15 illustrates an external perspective view of a solenoid actuator having an electromagnetic element.
Figure 16:
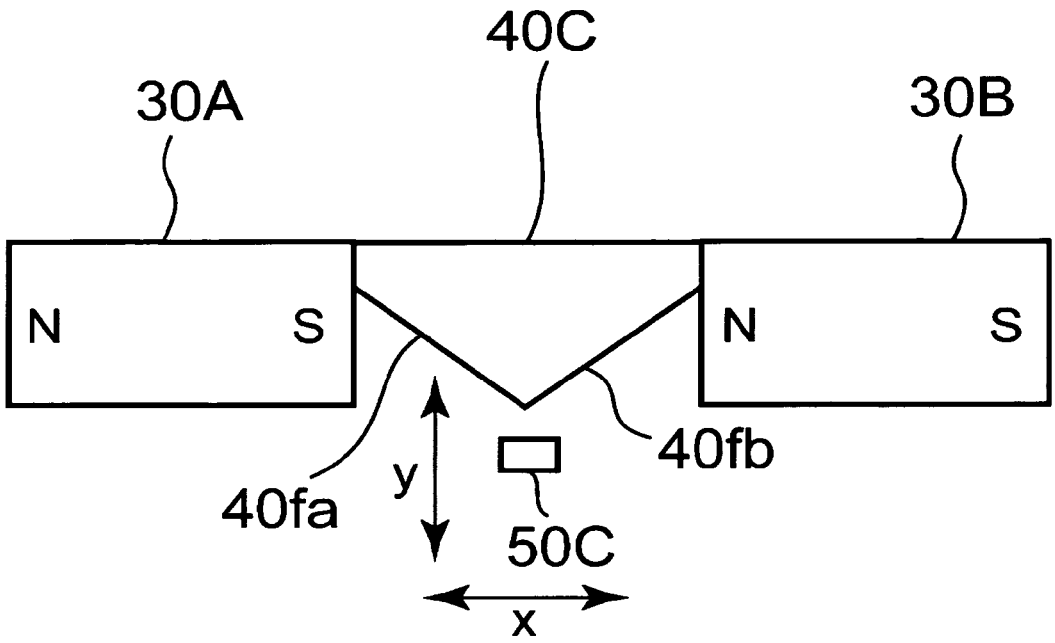
FIG. 16 illustrates a form example of a holding member.
Figure 17A:
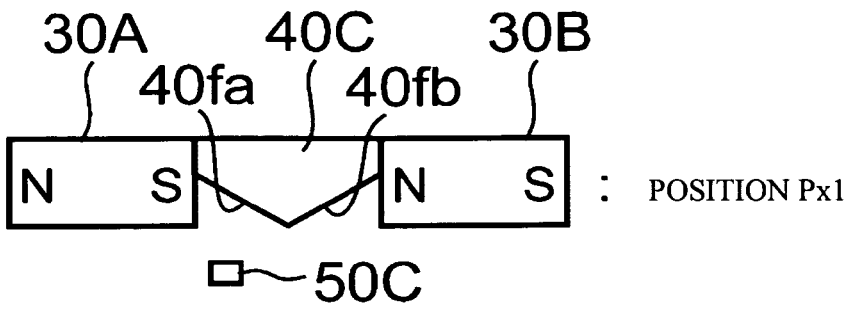
FIG. 17A through FIG. 17C illustrate a positional relationship between a core body and an electromagnetic element.
Figure 17B:
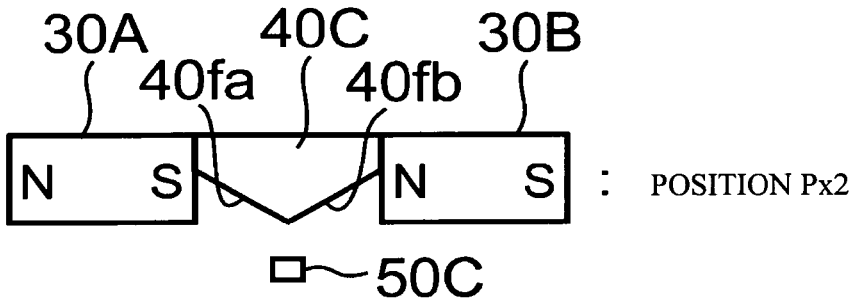
Figure 17C:
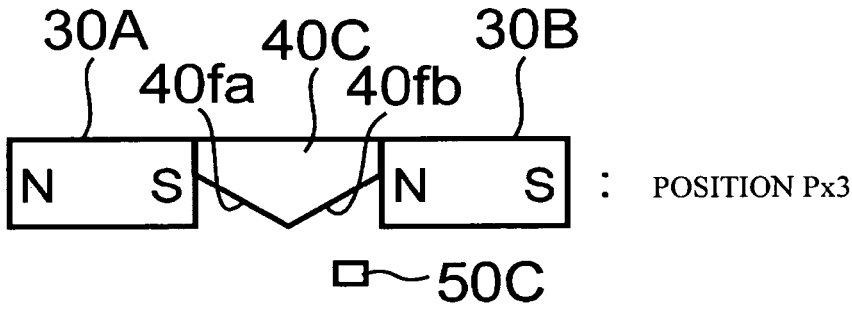
Figure 18:
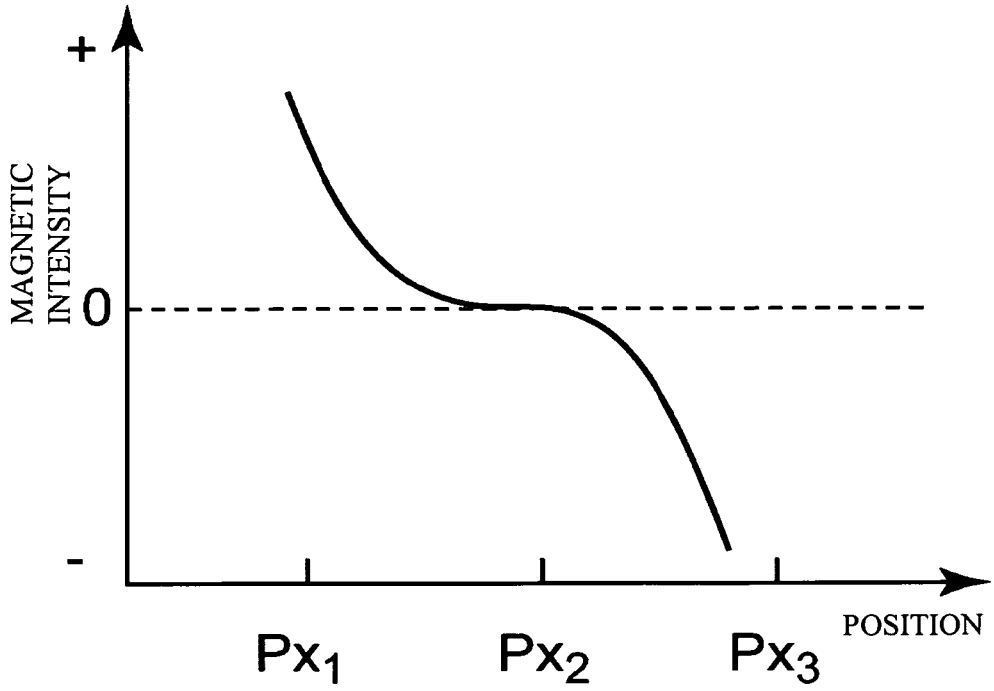
FIG. 18 illustrates a graph showing magnetic intensity which an electromagnetic element detects at every position.

FIG. 15 illustrates an external perspective view of the solenoid actuator having an electromagnetic element. FIG. 16 illustrates a shape example of a holding member. FIG. 17A through FIG. 17C illustrate a positional relationship between a core body and the electromagnetic element. FIG. 18 illustrates a graph showing magnetic intensity which the electromagnetic element detects at every position.

As shown in FIG. 15 and FIG. 16, a holding member 40C made of a ferromagnetic material has sloping surfaces 40*fa* and 40*fb* projecting to an electromagnetic element 50C and sloping in opposite directions to each other.

The electromagnetic element 50C is arranged facing to approximately center of the holding member 40C in the x-direction, when the core body is positioned at a reference position. The electromagnetic element 50C detects a magnetic intensity in a y-direction vertical to the x-direction (the direction where the electromagnetic element 50C faces to the keeping member 40C).

Here, as shown in FIG. 17A through FIG. 17C, relative positions between the electromagnetic element 50C and the core body are referred to Px1, Px2 and Px3 respectively. In this case, a magnetic intensity detected by the electromagnetic element 50C is, for example, shown in FIG. 18.

That is, in the graph shown in FIG. 18, the magnetic intensity indicates plus at the position Px1 where the electromagnetic element 50C faces to the sloping surface 40*fa*, and indicates minus at the position Px3 where the electromagnetic element 50C faces to the sloping surface 40*fb*. It is possible to detect the position of the core body with the magnetic intensity changing in this way.

Next, a description will be given of a solenoid actuator in accordance with another embodiment, with reference to FIG. 19 through FIG. 21.

Figure 19:
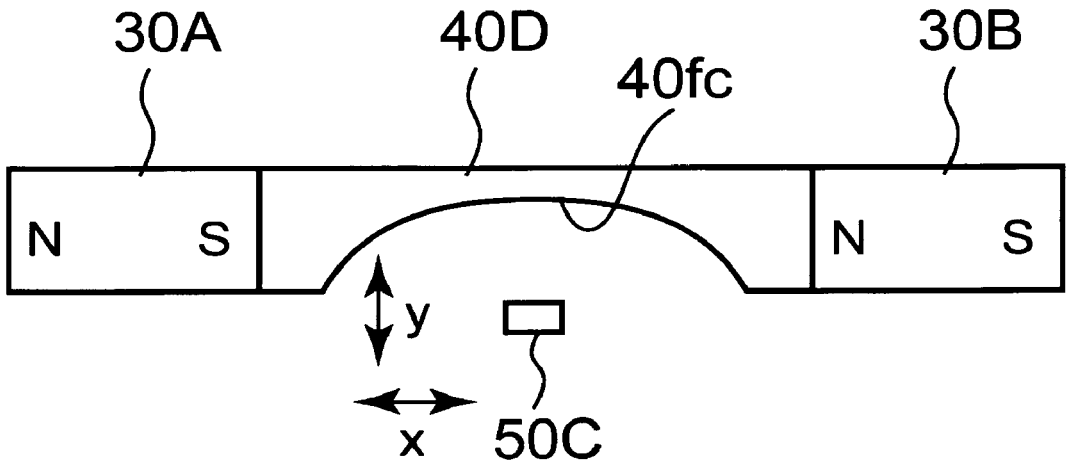
FIG. 19 illustrates a form example of a holding member.
Figure 20A:
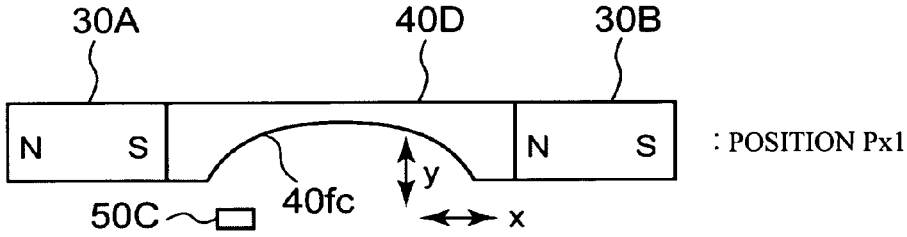
FIG. 20A through FIG. 20C illustrate a positional relationship between a core body and an electromagnetic element.
Figure 20B:
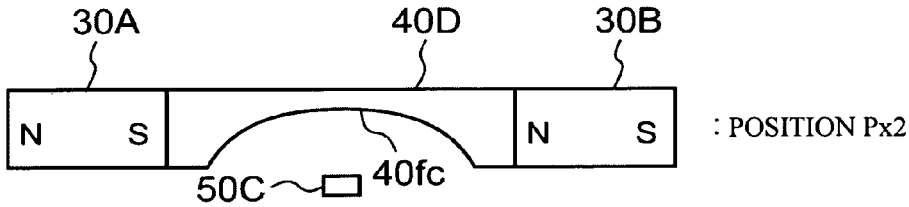
Figure 20C:
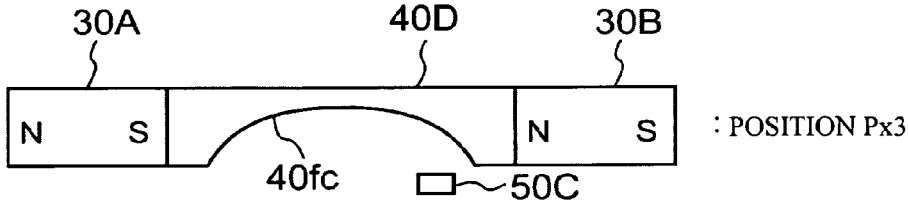

FIG. 19 illustrates a shape example of a holding member. FIG. 20A through FIG. 20C illustrate a positional relationship between a core body and the electromagnetic element. FIG. 21 illustrates a graph showing magnetic intensity which the electromagnetic element detects at every position.

As shown in FIG. 19, a holding member 40D made of a ferromagnetic material has a curved surface 40*fc* concaved for the electromagnetic element 50C.

Here, as shown in FIG. 20A through FIG. 20C, relative positions between the electromagnetic element 50C and the core body are referred to Px1, Px2 and Px3 respectively. In this case, the magnetic intensity detected by the electromagnetic element 50C is, for example, shown in FIG. 21.

Figure 21:
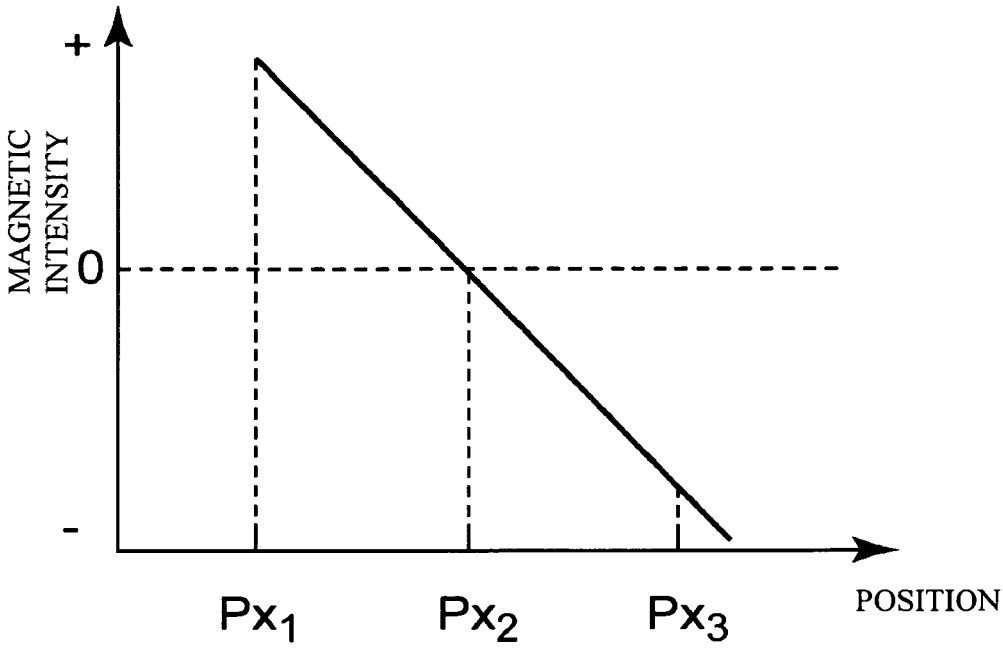
FIG. 21 illustrates a graph showing magnetic intensity which an electromagnetic element detects at every position.

In the graph shown in FIG. 21, the magnetic intensity changes approximately linearly. It is possible to change the magnetic intensity approximately linearly and to detect the position more accurately, when the curving surface 40*fc* is formed concaved for the electromagnetic element 50C.

Figure 22:
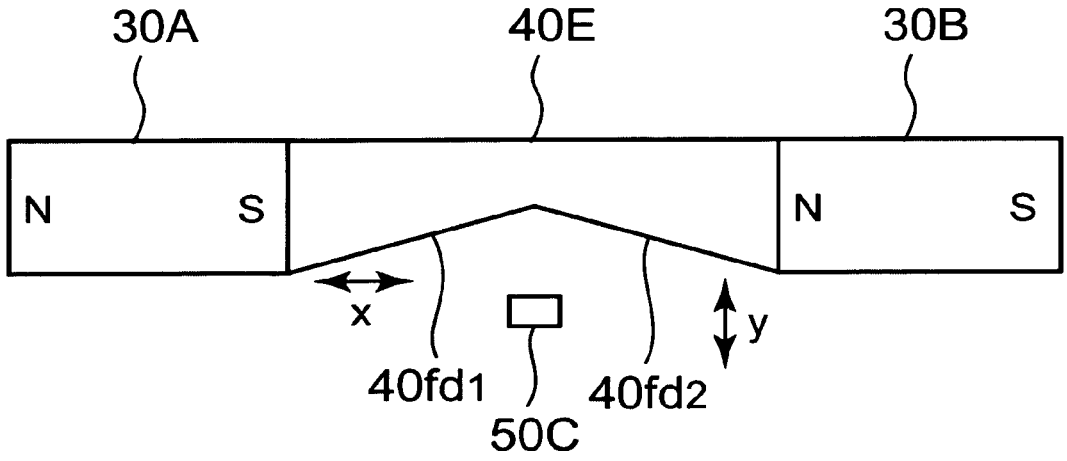
FIG. 22 illustrates another shape example of a holding member.

FIG. 22 illustrates another shape example of the holding member. As shown in FIG. 22, a holding member 40E has sloping surfaces 40*fd*1 and 40*fd*2 concaved for the electromagnetic element 50C and sloping in opposite directions to each other. It is possible to change the magnetic intensity approximately linearly as shown in FIG. 21, when the holding member 40E is formed as mentioned above.

Figure 23:
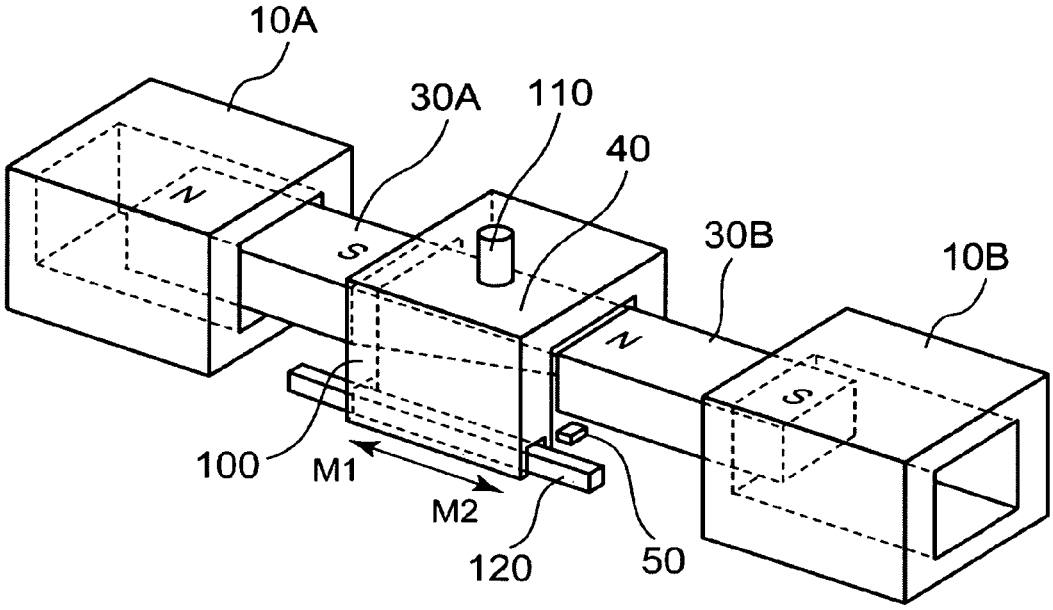
FIG. 23 illustrates a perspective view of a solenoid actuator in accordance with a seventh embodiment.

FIG. 23 illustrates a perspective view of a solenoid actuator in accordance with another embodiment. The solenoid actuator shown in FIG. 23 has a coupling member 100. The coupling member 100 holds the holding member 40 made of a ferromagnetic material and the magnets 30A and 30B therebetween. And the holding member 40 and the magnets 30A and 30B are coupled. The coupling member 100 is made of a nonmagnetic material such as a plastic or an aluminum alloy, and is guided by a rail 120 provided along the linear directions M1 and M2 so as to be movable. An operation portion 110 is provided projecting from the coupling member 100. When the coupling member 100 moves in the linear directions M1 and M2, the operation portion 110 conducts a movement to an operator.

Figure 24:
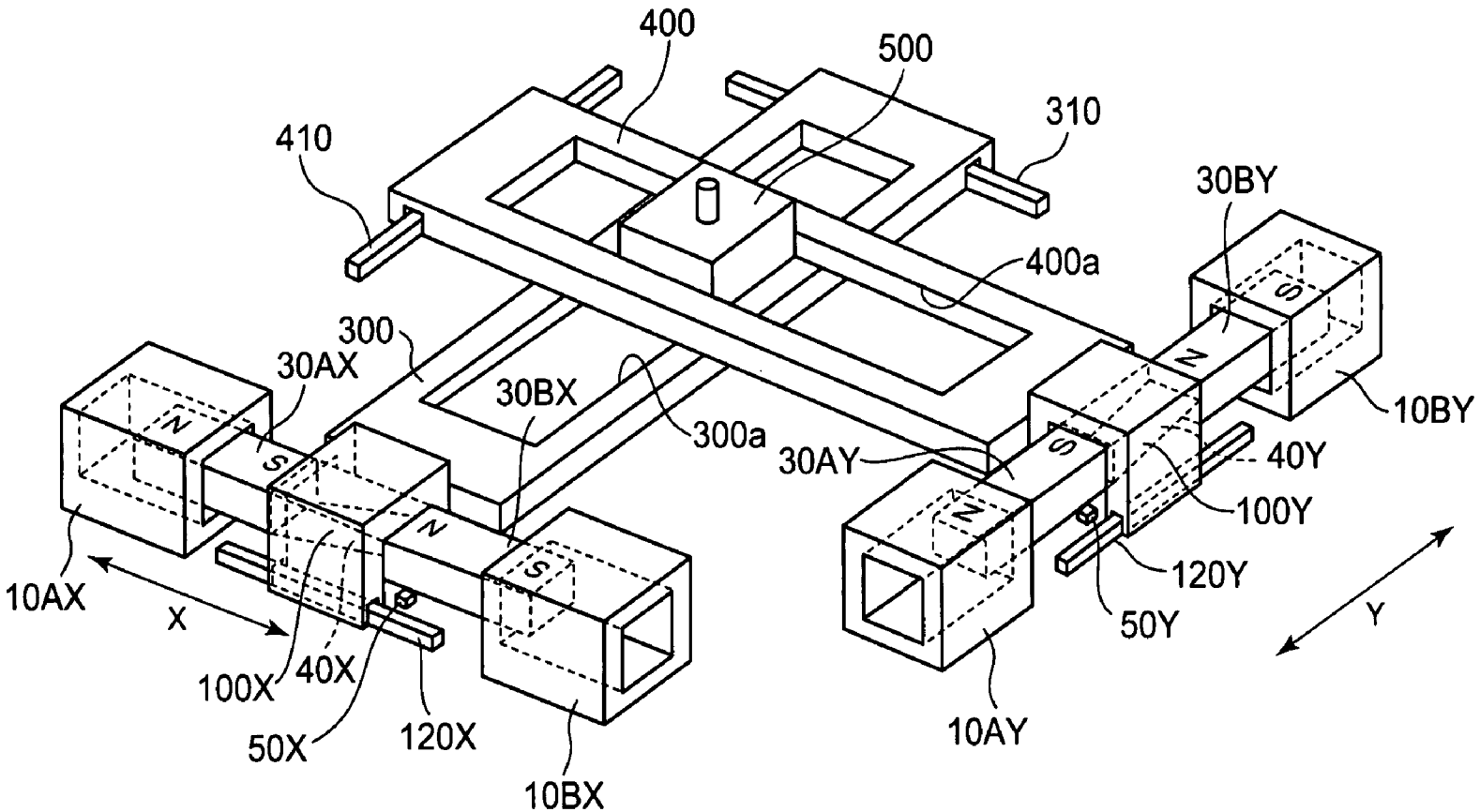
FIG. 24 illustrates a perspective view of a solenoid actuator in accordance with an eighth embodiment.

FIG. 24 illustrates a perspective view of a solenoid actuator in accordance with another embodiment. A biaxial actuator shown in FIG. 24 has a structure in which one solenoid actuator shown in FIG. 23 is arranged in an X-direction and another is arranged in a Y-direction vertical to the X-direction and coupling portions 100X and 100Y are coupled to an X-slider 300 and to a Y-slider 400 respectively. "X" is added to the additional numerals of the components of the solenoid actuator arranged along the X-direction. "Y" is added to those of the solenoid actuator arranged along the Y-direction.

The X-slider 300 is guided by a rail 310 arranged along the X-direction so as to be movable. The Y-slider 400 is guided by a rail 410 arranged along the Y-direction so as to be movable. An operation element 500 is guided by a guide 300*a* formed at the X-slider 300 and a guide 400*a* formed at the Y-slider 400 so as to be movable in the X-direction and the Y-direction. When the X-slider 300 and the Y-slider 400 move, the operation element 500 conducts a biaxial movement to an operator.

The embodiments above include but not limited to the case where the coils 10A and 10B are unmovable and the core body 20 is movable. The coils 10A and 10B may be movable and the core body may be unmovable.

While the above description constitutes the preferred embodiments of the present invention, it will be appreciated that the invention is susceptible of modification, variation and change without departing from the proper scope and fair meaning of the accompanying claims.

The present invention is based on Japanese Patent Application No. 2005-312396 filed on Oct. 27, 2005, the entire disclosure of which is hereby incorporated by reference.

What is claimed is:

1. A solenoid actuator comprising:

a pair of coils that are coupled electrically to each other in series;

a core body that has a pair of magnets and a holding member, and moves with respect to the coils when the pair of the coils apply magnetic force to the pair of the magnets in a substantially same direction; and an electromagnetic element converting a magnetic power generated by the magnet into an electrical signal in order to detect a relative position of the core body to the coil, wherein the magnets are inserted into the coils, respectively, the holding member holds the pair of the magnets in common, winding directions of the pair of the coils are opposite to each other, the pair of the magnets are arranged so that magnetization directions thereof are substantially equal in a movement direction of the core body with respect to the coils, the electromagnetic element is arranged facing to the holding member, the holding member is made of a ferromagnetic material or a magnetic material, the holding member is formed so that a distance between the holding member and the electromagnetic element changes when the core body moves with respect to the coil.

2. The solenoid actuator as claimed in claim 1, wherein:

a length of the magnet is substantially equal to or longer than that of the coil, and a magnetized surface of each of the magnets is positioned substantially near the center of the respective coil when the core body is positioned at a reference position.

3. The solenoid actuator as claimed in claim 1, wherein a facing surface of the holding member to the electromagnetic element is a sloping surface inclined to a movement direction of the core body with respect to the coil.

* * * * *